US007967496B2

(12) United States Patent
Wallgren

(10) Patent No.: US 7,967,496 B2
(45) Date of Patent: Jun. 28, 2011

(54) CONCRETE BATCH MIXER

(76) Inventor: Mark E. Wallgren, King City (CA)

( * ) Notice: Subject to any disclaimer, the term of this patent is extended or adjusted under 35 U.S.C. 154(b) by 936 days.

(21) Appl. No.: 11/855,474

(22) Filed: Sep. 14, 2007

(65) Prior Publication Data

US 2009/0073798 A1 Mar. 19, 2009

(51) Int. Cl.
*B28C 5/20* (2006.01)

(52) U.S. Cl. ..... 366/41; 366/44

(58) Field of Classification Search ..... 366/41, 366/57, 59, 183.3, 183.4, 228
See application file for complete search history.

(56) References Cited

U.S. PATENT DOCUMENTS 1,048,738 A * 12/1912 Sanborn ..... 366/57
1,058,803 A * 4/1913 Smith ..... 366/41
1,190,927 A * 7/1916 Mandt ..... 366/57
1,514,032 A * 11/1924 Blood ..... 366/41
3,112,100 A * 11/1963 Prichard ..... 366/41
4,268,175 A * 5/1981 Norlie et al. ..... 366/19
4,403,865 A 9/1983 Fejmert
5,380,085 A 1/1995 Milek
5,429,434 A 7/1995 Milek

* cited by examiner

*Primary Examiner* — David L Sorkin
(74) *Attorney, Agent, or Firm* — Ryan W. Dupuis; Kyle R. Satterthwaite; Ade & Company Inc.

(57) ABSTRACT

A batch mixer comprises a mixing drum rotatable about a longitudinal axis extending between an inlet opening and a discharge opening at opposing ends of the drum. Mixing members and transfer members supported in the drum mix the material when rotated in a first direction and transfer the material to the discharge opening when rotated in an opposing direction. An inlet chute for charging the drum and a discharge chute for emptying the drum communicate with the inlet opening and the discharge opening respectively. The inlet chute pivots relative to the drum about a vertical axis from a charging position in communication with the inlet opening to an access position in which the inlet opening is unobstructed by the inlet chute. The inlet end wall locating the inlet opening therein is removable for greater access.

21 Claims, 10 Drawing Sheets

CONCRETE BATCH MIXER

FIELD OF THE INVENTION

The present invention relates to a batch mixer of the type suitable for mixing concrete, and more particularly comprises a batch mixer of the type generally comprising a drum supported for rotation about longitudinal axis of the drum spanning between an inlet end for communication with an inlet charge chute and an outlet end for communication with a discharge chute.

BACKGROUND

In the concrete industry, it common for mixing cement with water and aggregate in a batch mixer. A common construction of a batch mixer comprises a drum supported for rotation about a respective longitudinal axis extending between an inlet opening at an inlet end of the drum and an outlet opening at an outlet end of the drum. A charging chute and a discharge chute communicate with the inlet opening and outlet opening respectively. An arrangement of blades supported within the drum serve to mix the material in the drum when the drum is rotated in a first mixing direction and serve to transfer the material from the inlet end to the outlet end for discharging through the discharge chute when rotated in an opposing transfer direction.

U.S. Pat. Nos. 5,429,434 and 5,380,085, both belonging to Milek, and U.S. Pat. No. 4,403,865 belonging to Fejmert, disclose examples of concrete batch mixers generally of the type described above. In these typical designs of batch mixers, very little access is typically provided to the interior of the drum for maintenance of the blades therein for example. The only access is typically provided through either the inlet opening or the outlet opening of the drum which generally comprises a small opening obstructed by either the respective inlet charging chute or discharge chute.

In some concrete batch mixers, the charging chute is known to be supported on a slide for sliding movement generally along the axis of rotation of the drum towards and away from the inlet end of the drum. Accordingly when the inlet chute is slid away from the drum some limited access is provided between the chute and the drum to enter through the inlet opening. A large cumbersome frame is required however to support the sliding chute which further blocks access to the inlet opening and the hollow interior of the drum.

SUMMARY OF THE INVENTION

According to one aspect of the present invention there is provided a batch mixer comprising:

a mixing drum supported for rotation about a respective longitudinal axis extending generally horizontally between an inlet end and an outlet end of the drum;

the mixing drum including a hollow interior arranged for receiving material to be mixed therein;

the inlet end of the drum including an inlet opening formed therein;

the outlet end of the drum having a discharge opening formed therein;

a drive arranged to rotate the mixing drum about the longitudinal axis to mix the material in the drum and to transfer the material in the drum towards the outlet end of the drum;

a plurality of mixing members supported in the hollow interior for rotation with the drum about the longitudinal axis;

the mixing members being arranged to mix the material in the hollow interior of the drum;

a plurality of transfer members supported in the hollow interior for rotation with the drum about the longitudinal axis;

the transfer members being arranged to transfer the material in the hollow interior towards the outlet end of the drum;

a discharge chute supported adjacent the outlet end of the drum and arranged for discharging material from the hollow interior of the mixing drum through the discharge opening at the outlet end;

an inlet chute supported adjacent the inlet end of the drum;

the inlet chute comprising a first opening at a top end arranged to receive the material therein, a second opening at a bottom end, and walls defining a passage from the first opening to the second opening;

the inlet chute being supported for pivotal movement relative to the drum about an inlet chute axis;

the inlet chute being pivotal about the inlet chute axis between a charging position in which second opening is in communication with inlet opening of drum, and an access position in which inlet opening is substantially unobstructed by the inlet chute.

According to a second aspect of the invention the drum may further comprise an end wall opening at the inlet end of the drum and an inlet end wall which is arranged to span the end wall opening, wherein the inlet opening is located in the inlet end wall and a fastening mechanism is arranged to support the inlet end wall spanning the end wall opening so as to permit ready separation and reattachment of the inlet end wall to the inlet end of the drum.

When providing an inlet chute which is pivotally supported about a respective vertical chute axis, or which is further laterally offset relative to the end wall of the drum, the inlet chute can be pivoted fully clear of the inlet end wall to provide full access to the inlet opening. Furthermore by providing an inlet end wall locating the inlet opening therein and which itself is removable, even greater access is provided to the interior of the drum for maintenance of the various mixing and transfer members therein as may be desired. By further arranging the frame which supports the inlet chute pivotally thereon to be in a common plane at the inlet end of the drum and to have members offset away from the end wall, very little obstruction is provided for maintenance operations inside the drum.

The inlet chute axis preferably comprises a vertical axis.

The inlet chute axis may be spaced radially outward from the longitudinal axis beyond a periphery of the inlet opening, and more preferably is spaced radially outward from the longitudinal axis beyond a periphery of the inlet end wall.

The second opening of the inlet chute preferably lies in a generally vertical plane, while the first opening of the inlet chute preferably lies in a generally horizontal plane such that the passage is sloped downwardly at incline from the first opening towards the second opening.

Preferably there is provided a fixed frame which is in fixed relation to the longitudinal axis of the drum and which pivotally supports the inlet chute thereon. A pair of hinges vertically spaced apart along the inlet chute axis may support the inlet chute on the fixed frame. The hinges are preferably adjustable in position relative to the fixed frame along three different axes which are perpendicular to one another.

The pair of hinges may be coupled to one another so as to be arranged for common adjustment of position together relative to the fixed frame in a direction of the inlet chute axis while being arranged for independent adjustment of position relative to fixed frame along two different axes oriented perpendicular to one another and to the inlet chute axis.

The inlet chute may be supported on a frame assembly comprising a pair of horizontal frame members which are pivotal with the inlet chute about the inlet chute axis relative to the fixed frame. Each frame member of the frame assembly is preferably pivotally supported by a hinge at the inlet chute axis at one end of the frame assembly and is preferably arranged to be supported on a cradle member on the fixed frame at the other end of the frame assembly in the charging position.

The inlet chute and frame members of the frame assembly are preferably arranged to be supported wholly by the hinges and the cradle members so that when there is provided a retainer arranged to selectively retain the frame members on the cradle members, the retainer member does not provide structural support to the inlet chute in the charging position.

Each cradle member may comprise a supporting surface arranged to support a portion of the frame assembly thereon in the charging position and an inclined surface which is sloped relative to the supporting surface and arranged to guide alignment of the portion of the frame assembly with the supporting surface of the cradle member as the frame assembly is displaced towards the charging position.

Each cradle member may include a stop arranged to prevent pivotal movement of the inlet chute from the access position beyond the charging position.

The fixed frame supporting the inlet chute thereon may comprise a pair of upright posts spaced apart on opposing sides of the inlet end wall. One of the pair of frame members of the frame assembly preferably spans generally horizontally adjacent a top end of the inlet opening and one of the pair of frame members of the frame assembly preferably spans generally horizontally adjacent a bottom end of the inlet opening. The fixed frame may thus lie in a generally common upright plane adjacent the inlet end wall.

According to a further aspect of the present invention there is provided a batch mixer comprising:

a mixing drum supported for rotation about a respective longitudinal axis extending generally horizontally between an inlet end and an outlet end of the drum;

the mixing drum including a hollow interior arranged for receiving material to be mixed therein;

the inlet end of the drum including an inlet opening formed therein;

the outlet end of the drum having a discharge opening formed therein;

a drive arranged to rotate the mixing drum about the longitudinal axis to mix the material in the drum and to transfer the material in the drum towards the outlet end of the drum;

a plurality of mixing members supported in the hollow interior for rotation with the drum about the longitudinal axis;

the mixing members being arranged to mix the material in the hollow interior of the drum;

a plurality of transfer members supported in the hollow interior for rotation with the drum about the longitudinal axis;

the transfer members being arranged to transfer the material in the hollow interior towards the outlet end of the drum;

a discharge chute supported adjacent the outlet end of the drum and arranged for discharging material from the hollow interior of the mixing drum through the discharge opening at the outlet end;

an inlet chute supported adjacent the inlet end of the drum;

the inlet chute comprising a first opening at a top end arranged to receive the material therein, a second opening at a bottom end through which the material is arranged to be dispensed into the drum, and walls defining a passage from the first opening to the second opening;

the inlet chute being supported for movement between a charging position in which second opening is in communication with inlet opening of drum, and an access position in which inlet chute is spaced from the inlet opening of the drum;

the drum comprising an end wall opening at the inlet end of the drum and an inlet end wall which is arranged to span the end wall opening;

the inlet opening being located in the inlet end wall; and a fastening mechanism arranged to support the inlet end wall spanning the end wall opening so as to permit ready separation and reattachment of the inlet end wall to the inlet end of the drum.

The fastening mechanism may comprise a plurality of threaded fasteners fastening the inlet end wall to the drum about a periphery of the end wall opening at the inlet end of the drum.

The drum may be reduced in diameter towards the inlet end thereof such that the inlet end wall spanning the inlet end of the drum is smaller in diameter than the drum.

The inlet end wall preferably spans perpendicular to the longitudinal axis of the drum.

The inlet end wall preferably supports a sealing member about the inlet opening in the inlet end wall such that the sealing member is arranged for rotatable engagement with the inlet chute for relative rotation therebetween in the charging position of the inlet chute.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
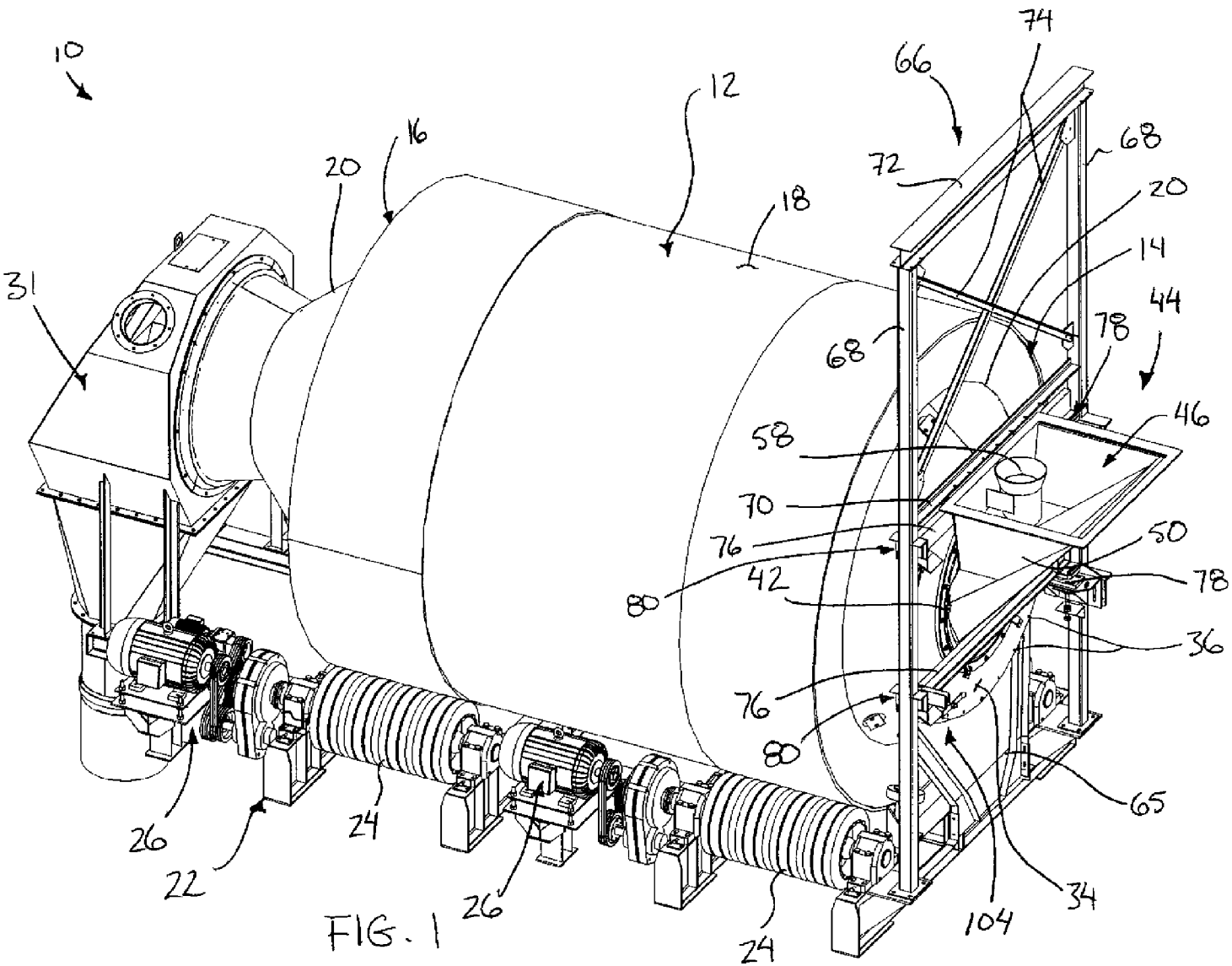
FIG. 1 is a perspective view of the batch mixer.
Figure 2:
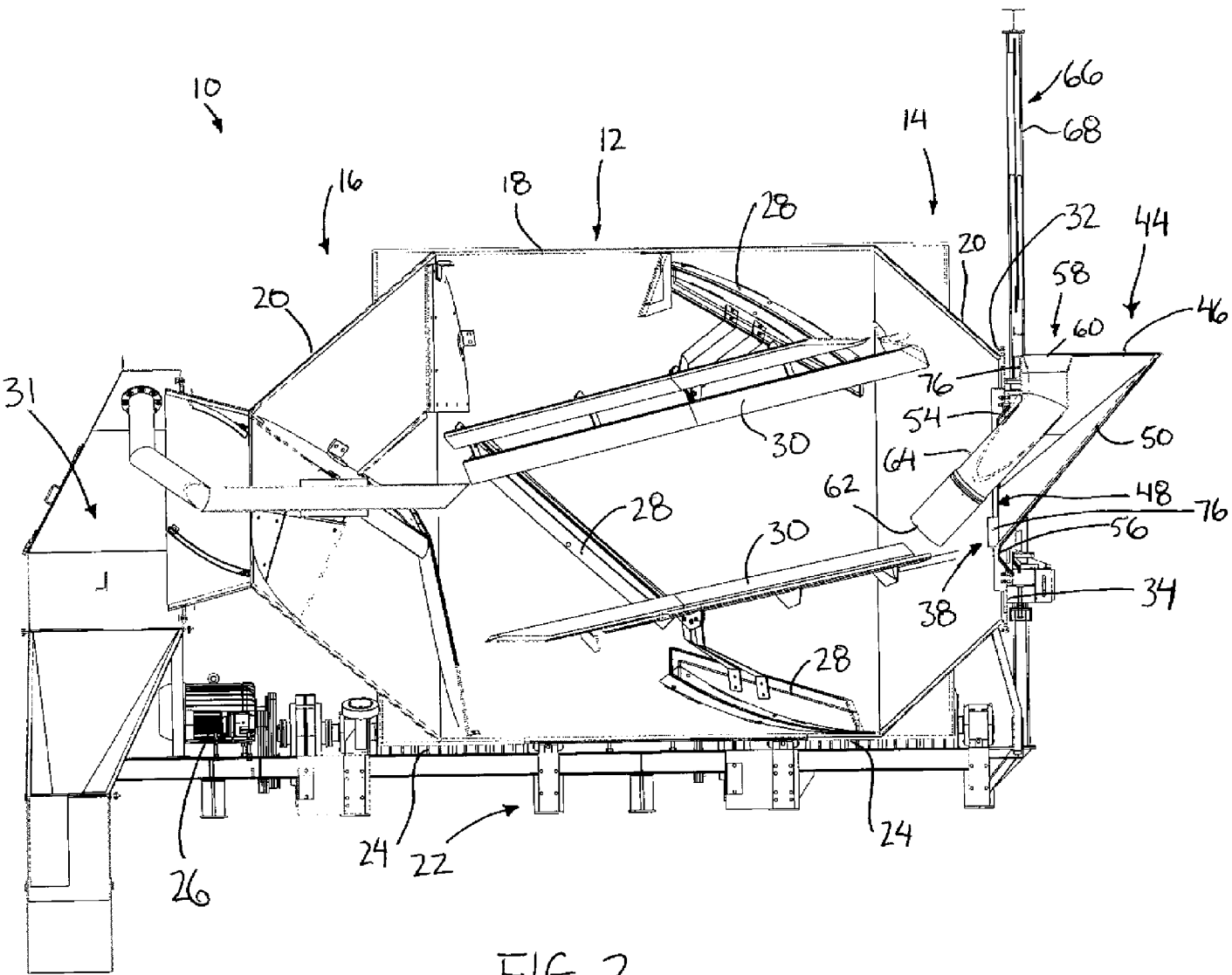
FIG. 2 is an elevational view of a longitudinal cross section of the mixer.
Figure 3:
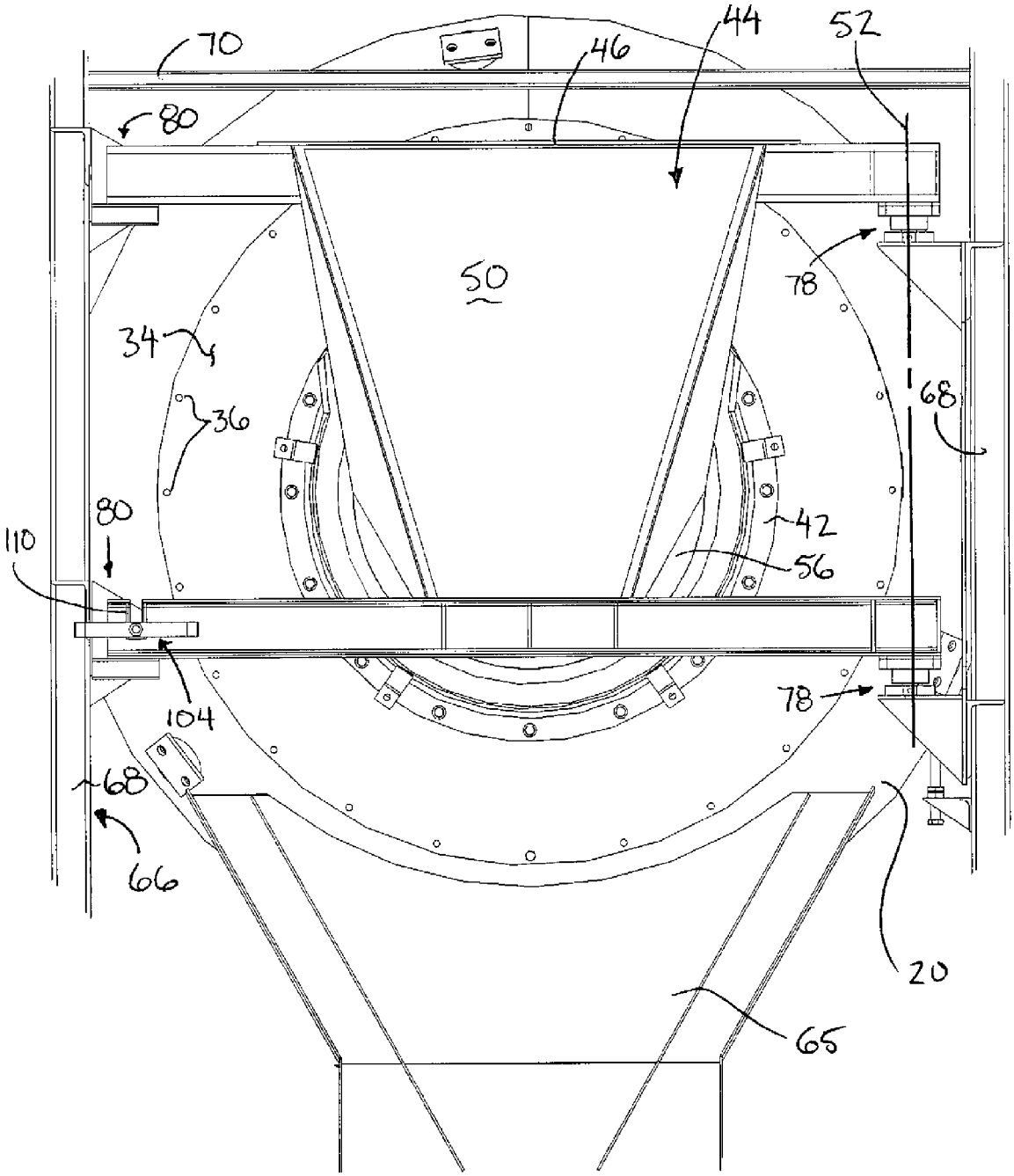
FIG. 3 is an elevational view of the inlet end of the drum.
Figure 4:
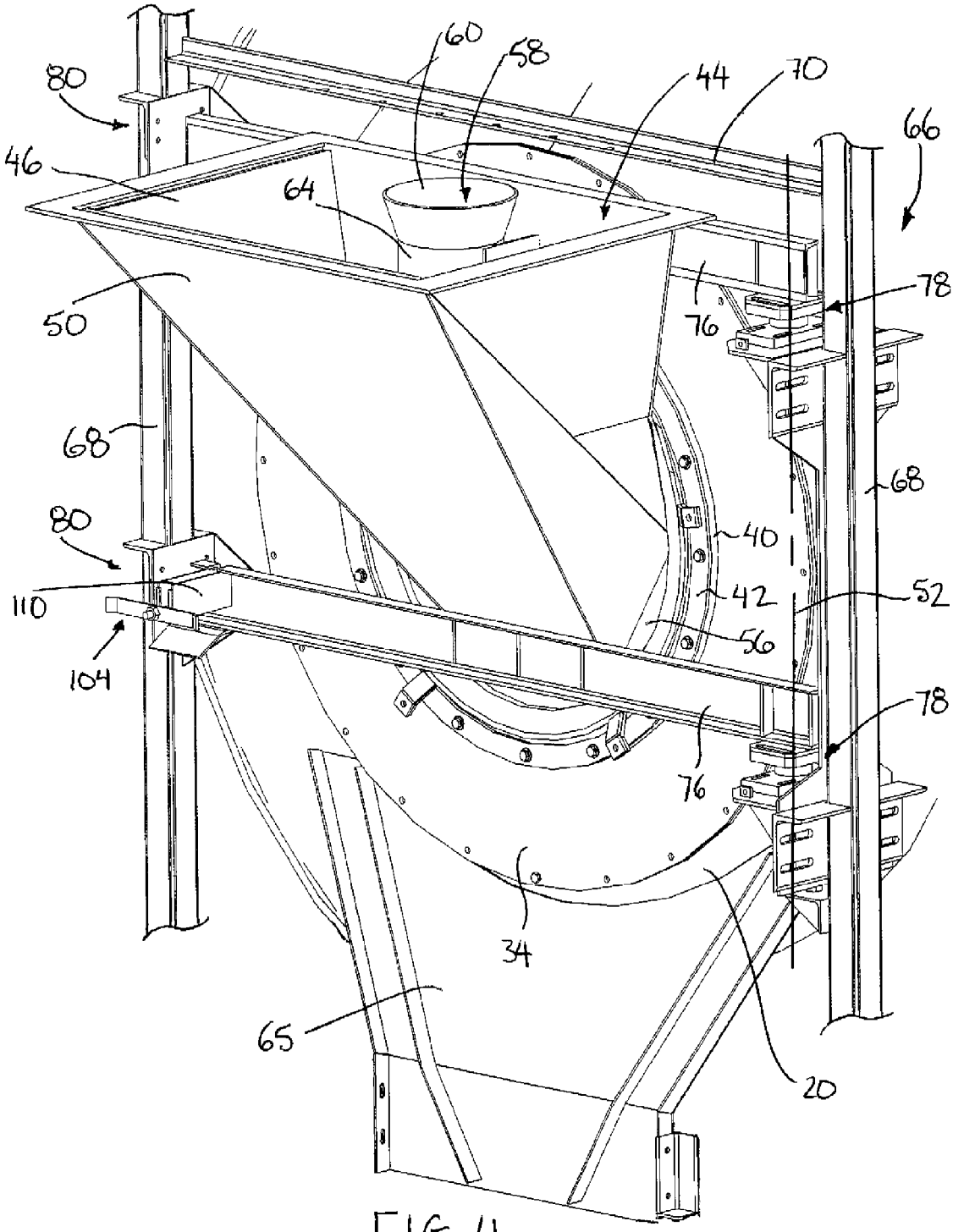
FIG. 4 is a perspective view of the inlet end of the drum.
Figure 5:
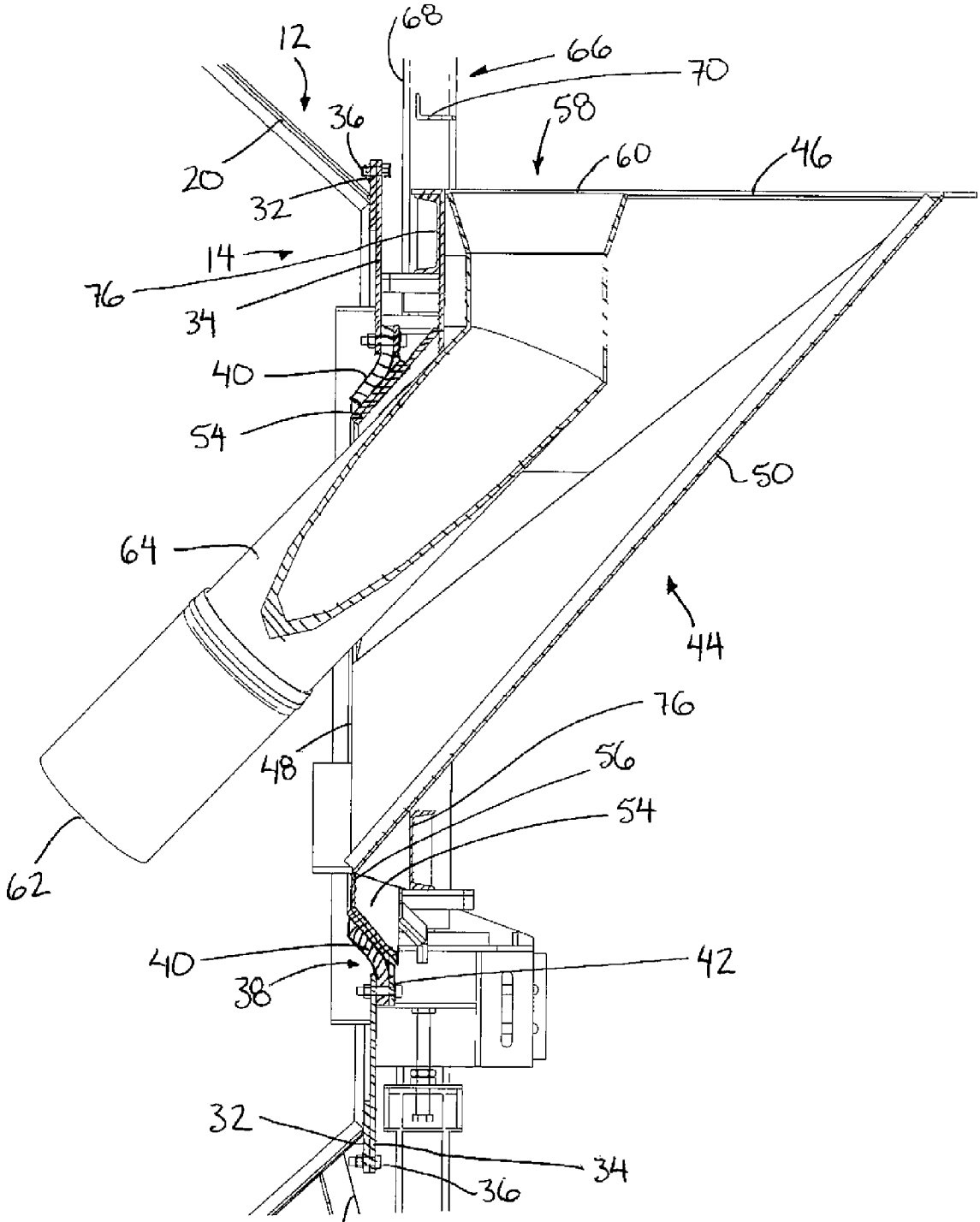
FIG. 5 is a sectional view of the inlet chute at the inlet end of the drum along the longitudinal axis of the drum.
Figure 6:
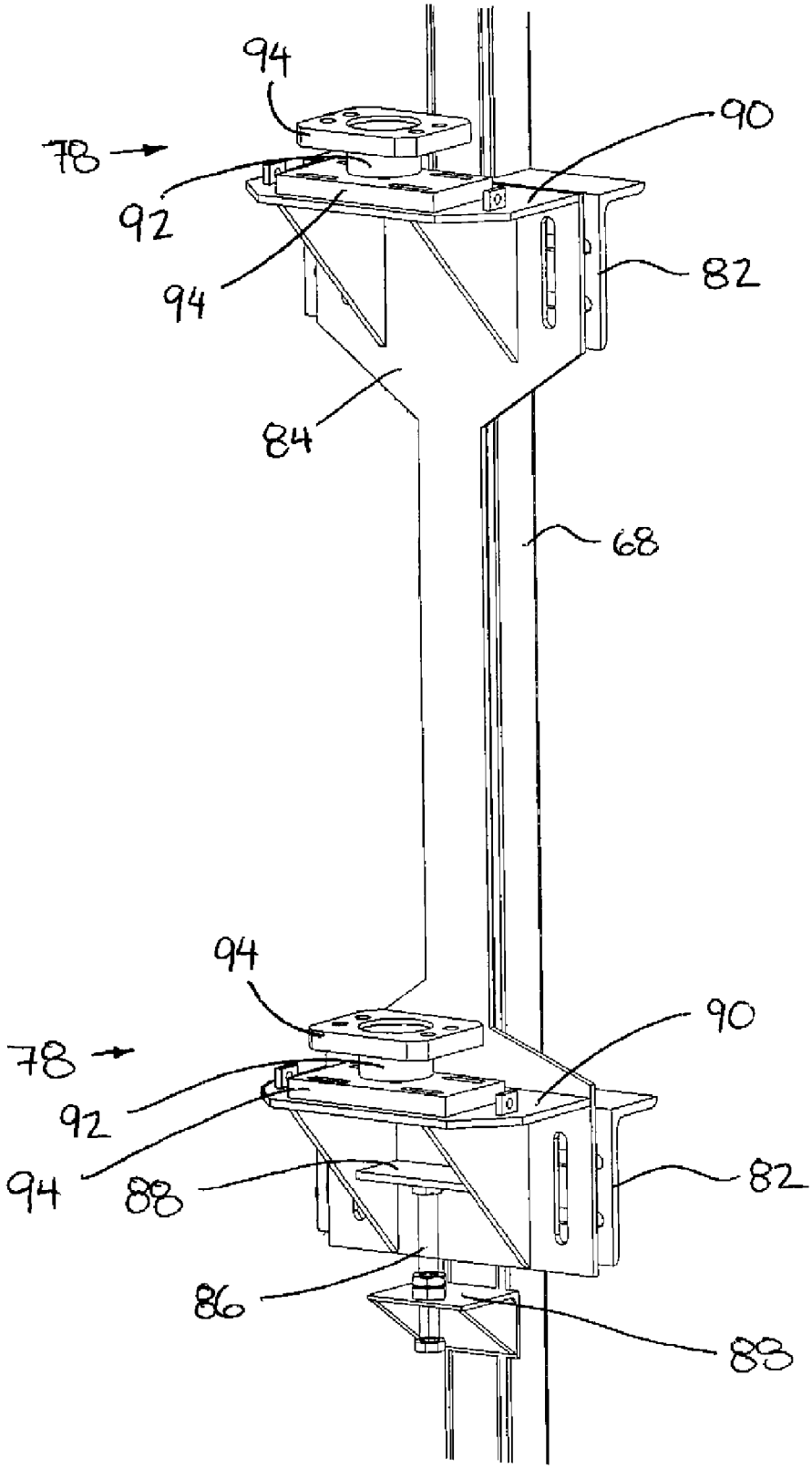
FIG. 6 is a perspective view of the hinges supporting the inlet chute.
Figure 7:
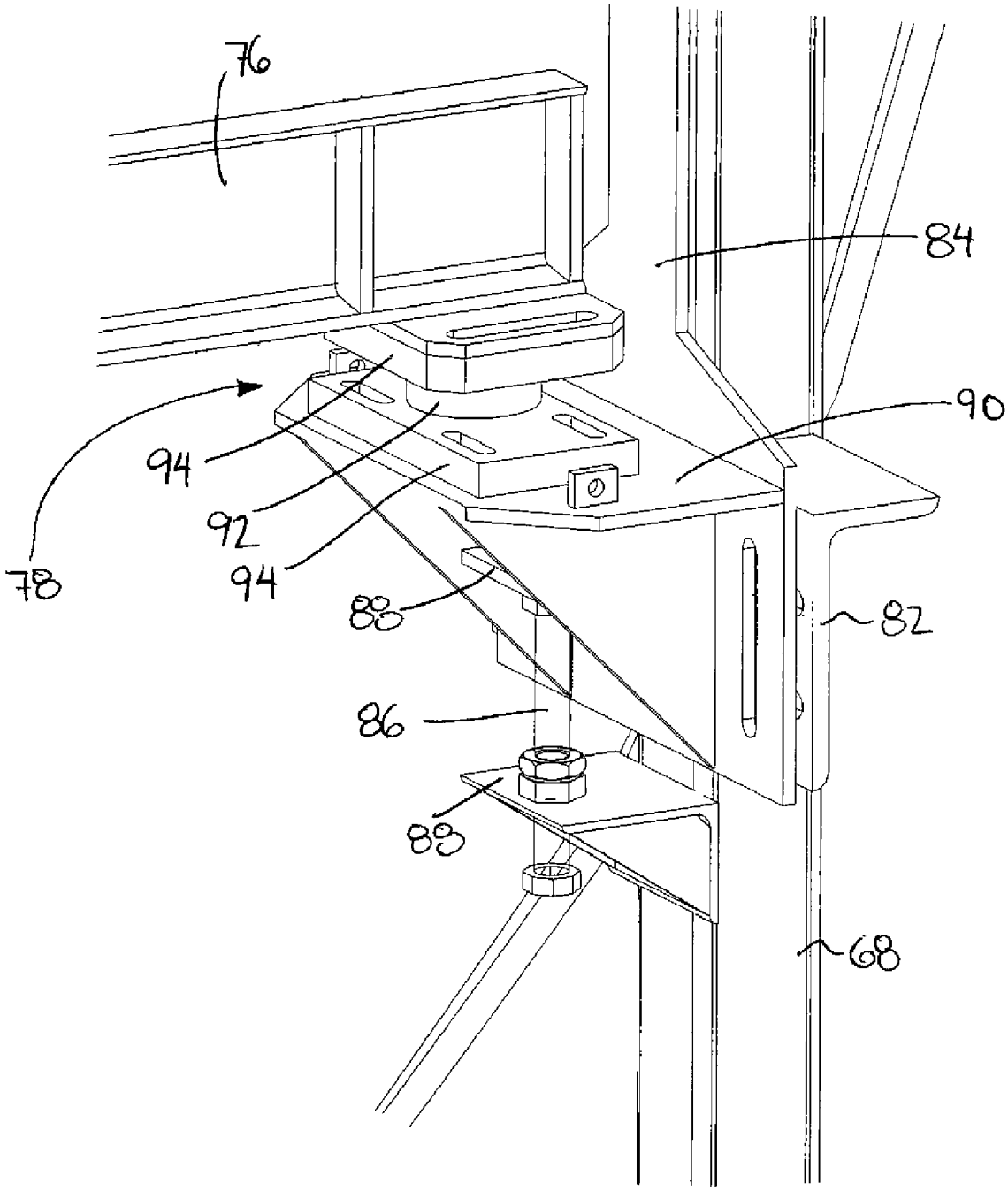
FIG. 7 is a perspective view of a lowermost one of the frame members shown coupled to the respective hinge.
Figure 8:
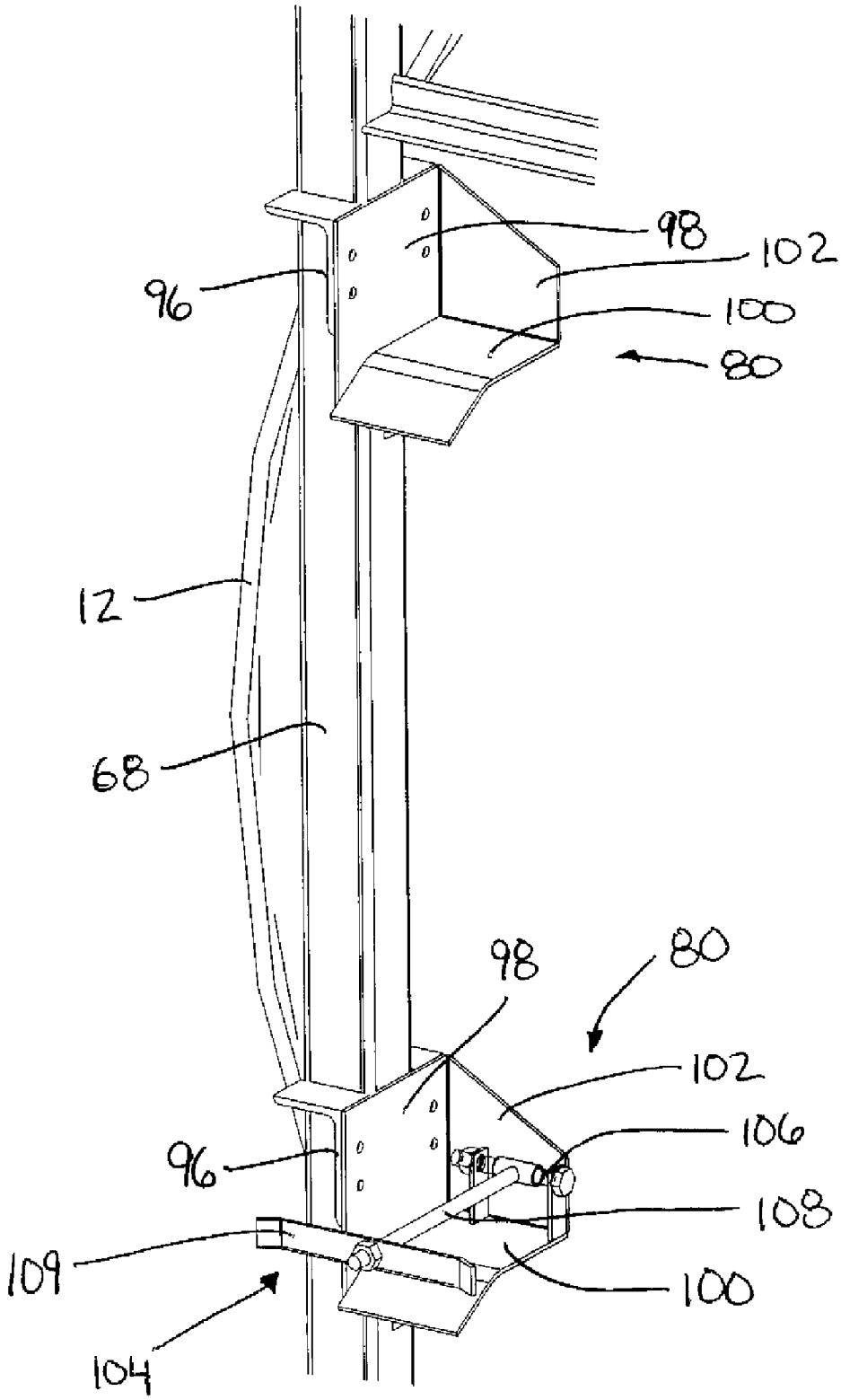
FIG. 8 is a perspective view of the cradle members supported on one of the posts of the fixed frame.
Figure 9:
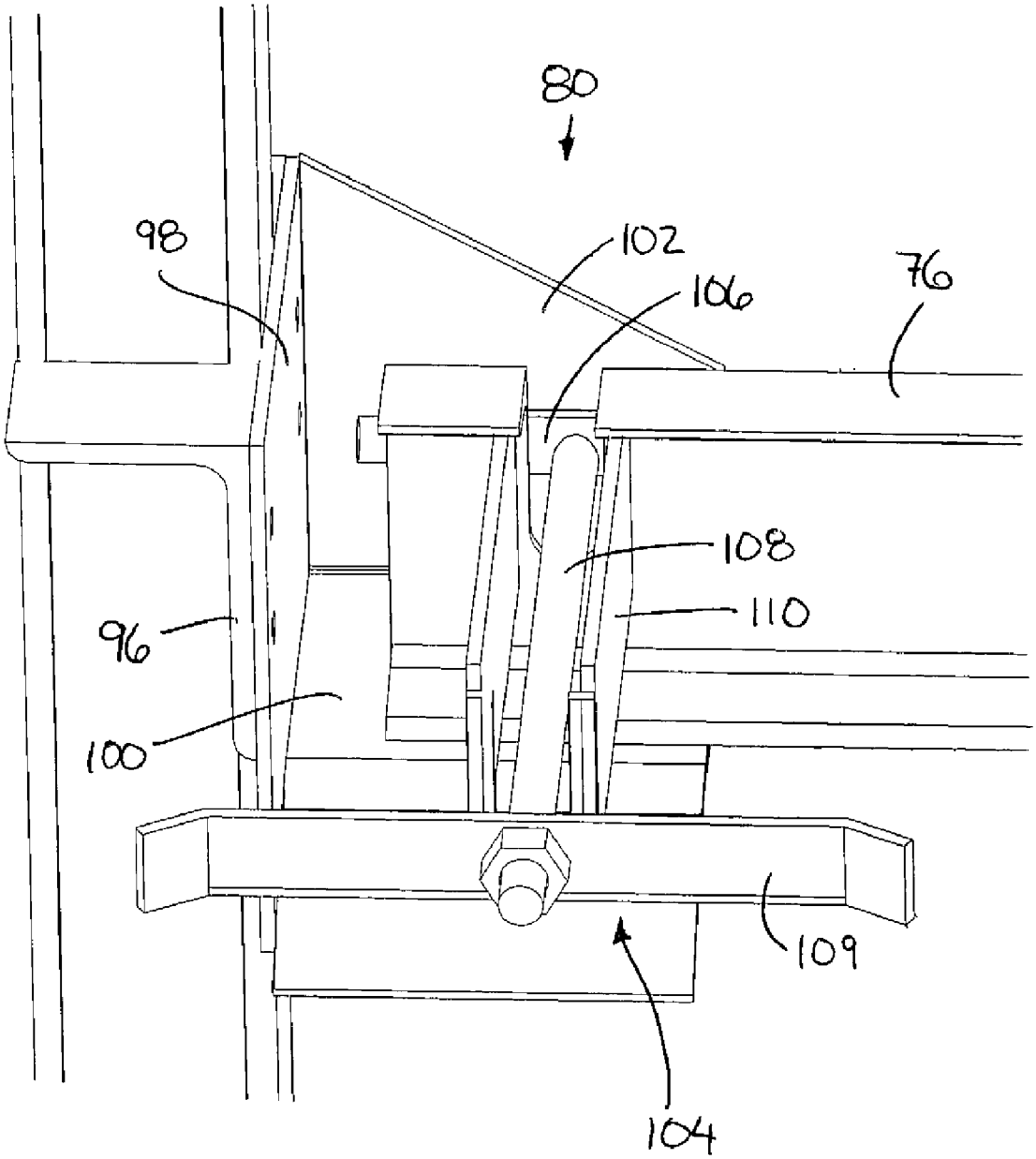
FIG. 9 is a perspective view of the retainer shown in a latched position.
Figure 10:
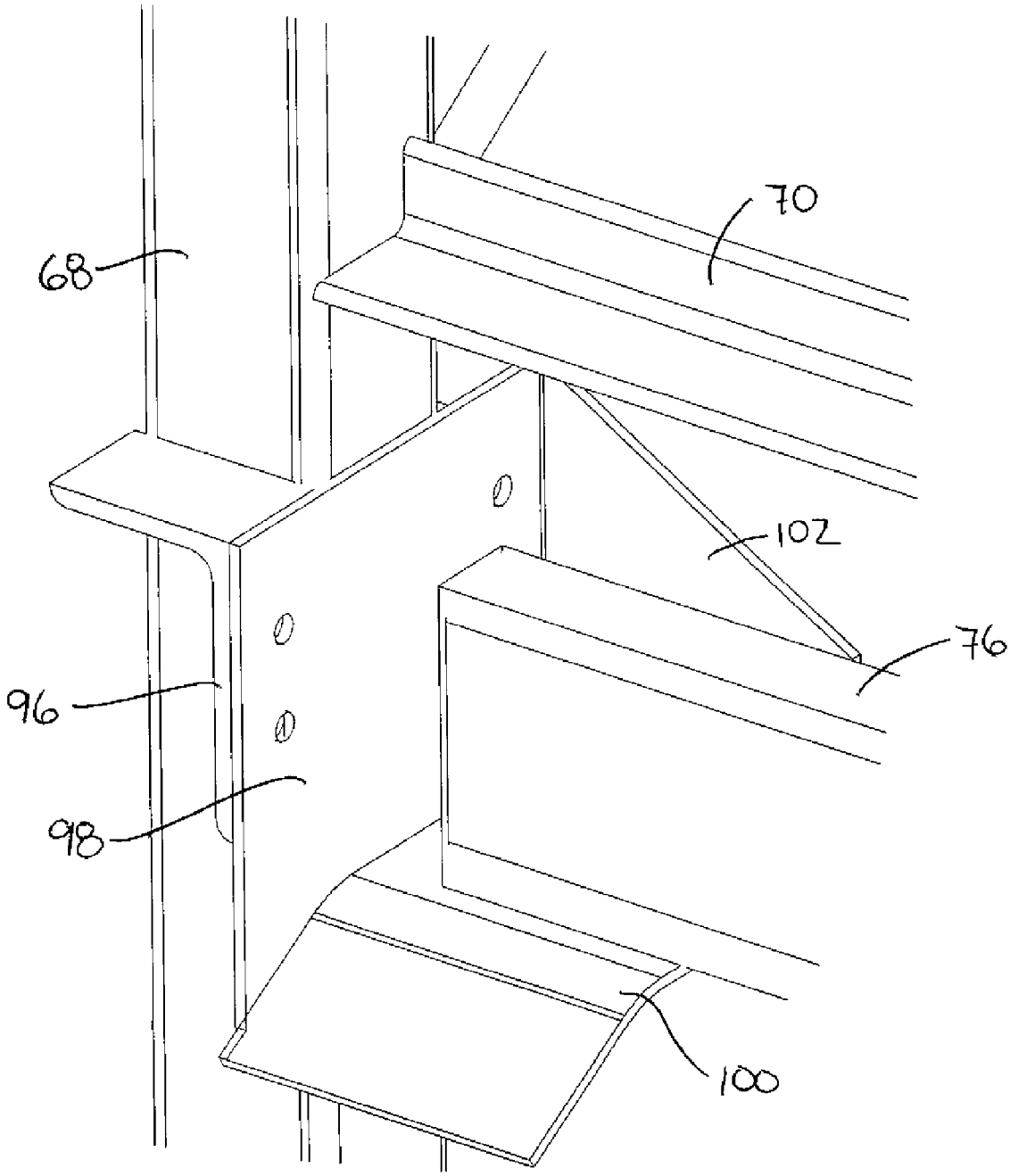
FIG. 10 is a perspective view of an uppermost one of the cradle members shown with the end of the respective frame member supported thereon.

Referring to the accompanying figures there is illustrated a batch mixer generally indicated by reference numeral 10. The mixer 10 is particularly suited for batch mixing of concrete.

The mixer includes a mixing drum 12 comprising a generally cylindrical shell having a longitudinal axis extending generally horizontally between an inlet end 14 and an outlet end 16. The cylindrical shell surrounds a hollow interior of the mixing drum which receives material therein to be mixed.

The cylindrical shell includes a central main portion 18 which includes generally straight walls which are cylindrical about the longitudinal axis, and a pair of tapered end sections 20 in which the walls of the shell taper inwardly to be reduced in diameter towards the respective inlet and outlet ends of the drum. Each tapered end section is accordingly generally frustoconical in shape so as to reduce in diameter from the main portion 18 to the respective end of the drum.

The mixing drum 12 is rotatably supported on a base frame 22. The base frame 22 is arranged to be fixedly supported on the ground and includes a plurality of rollers rotatably supported thereon which in turn rotatably support the drum 12 for rotation about its horizontally extending longitudinal axis. Motors 26 are provided on the base frame which serve to drive rotation of the drum 12 about its axis relative to the frame in either first or second opposing directions.

A plurality of transfer members 28 are supported on the inner surface of the mixing drum within the hollow interior thereof which are arranged to urge material in the drum from the inlet end to the outlet end thereof as the drum is rotated in a first transfer direction about the longitudinal axis. Each transfer member generally comprises a plate like blade which projects radially inwardly from the cylindrical shell wall of the drum at an inclination to the longitudinal axis.

The mixer also includes a plurality of mixing members 30 supported within the hollow interior which serve to mix the material in the drum when the drum is rotated in a mixing direction opposite to the transfer direction. The mixing members comprising elongate plate like blades which extend generally in the longitudinal direction of the drum at an inclination to the longitudinal axis and at a position spaced radially inwardly from the cylindrical shell defining the outer walls of the drum. Each mixing member 30 is supported on a respective one of the transfer members by a suitable mounting bar spanning therebetween. The transfer members also serve to assist in mixing the material when rotated in the mixing direction.

The outlet end 16 of the mixing drum 12 has a discharge opening 29 therein which fully spans in a vertical plane at the end of the tapered section 20 at the outlet end 16. A discharge chute 31 communicates through the discharge opening 29 to discharge material from the interior of the mixing drum 12 when the mixing drum is rotated in the transfer direction. The configuration of the discharge chute is known to persons skilled in the art and accordingly is not further described herein.

The inlet end 14 of the mixing drum 12 has an end wall opening therein which fully spans the end of the tapered section 20 at the inlet end so that the end wall opening spans a vertical plane. A peripheral mounting flange 32 projects radially outward from the end of tapered section 20 about the end wall opening at the inlet end of the drum. The flange 32 serves to support an inlet end wall 34 thereon. The inlet end wall fully spans the end wall opening and is secured about the periphery thereof by a plurality of threaded fasteners 36 which fasten the end wall to the mounting flange 32 at a plurality of circumferentially spaced positions. The threaded fasteners 36 allow the inlet end wall to remain readily separable and reattachable to the inlet end of the drum 12. Removing the end wall 34 provides greater access to the interior of the drum for performing various maintenance operations to the interior of the drum for example.

The removable inlet end wall 34 at the inlet end of the drum includes an inlet opening 38 centrally located therein. A sealing member 40 is mounted in the inlet opening 38 and comprises a resilient annular member supported about the inner edge of the end wall 34 about the opening to project radially inward therefrom. An annular mounting plate 42 includes mounting apertures therein for alignment with mounting apertures spaced circumferentially about the inner edge of the end wall 34 about the inlet opening 38 for fastening the annular mounting plate to the end wall 34 with the sealing member 40 being clamped therebetween. The opening in the annular mounting plate 42 is near in dimension to the inlet opening 38 in the end wall 34 so that the sealing member 40 projects radially inward from both the inner edge of the inlet end wall 34 and the annular mounting plate 42.

An inlet chute 44 is provided for communication through the inlet opening 38 to introduce material into the drum 12 therethrough. The inlet chute includes a first opening 46 lying in a horizontal plane at a top end of the inlet chute 44. A second opening 48 is provided in a vertical plane at the bottom end of the inlet chute 44. The chute includes a plurality of chute walls 50 which define a passage between the first opening 46 and the second opening 48 which extends at a downward slope inclined from vertical from the first opening to the second opening.

The chute 44 is supported for pivotal movement about a vertical chute axis 52 between a charging position in which the second opening 48 communicates with the inlet opening 38 so that the inlet chute is located directly adjacent the inlet end of the drum and an access position in which the chute assembly is pivoted away from the inlet end of the drum and the inlet opening therein so that the inlet opening is substantially unobstructed by the chute 44.

The chute axis 52 is positioned to be spaced radially outward from the axis of the drum beyond a periphery of the end wall 34. Accordingly when the inlet chute is pivoted into the access position, full unobstructed access is also provided to the end wall opening when the inlet end wall 34 is removed. The bottom end of the inlet chute 44 locating the second opening 48 therein is arranged for rotatable and sealable engagement with the sealing member 40 about the inlet opening 38. For this purpose the bottom end of the inlet chute 44 includes a frustoconical collar 54 which is concentric with the longitudinal axis of the drum in the charging position of the chute 44.

The collar 54 is arranged to have a diameter at the outer end which is near a diameter of the inner edge of the end wall defining the inlet opening 38 so as to be greater in diameter than the free inner edge of the annular sealing member 40. The collar 54 tapers inwardly to be reduced in diameter towards the inner end which has a diameter which is near to the diameter defined by the inner edge of the annular sealing member 40 and which is accordingly smaller in diameter than the inner edge of the end wall 34 defining the inlet opening 38.

In the charging position, the collar 54 is arranged to project through the plane of the inlet opening 38 to deflect the free inner edge of the annular sealing member 40 inward into the hollow interior of the drum. The deflection of the sealing member 40 causes the sealing member to lay flat against an outer side of the collar 54 to provide a seal therebetween while allowing relative rotation therebetween due to the collar 54, the sealing member 40 and the inlet opening 38 all being concentric about the longitudinal axis of rotation of the mixing drum 12.

An end plate 56 is provided to span the gap between the inner surface of the collar 54 and the outer side of the walls 50 defining the passage of the inlet chute 44.

An auxiliary chute 58 is provided which is smaller in cross section than the passage of the inlet chute 44 so as to permit the auxiliary chute 58 to be received through the passage of the inlet chute 44. The chute 58 extends from a first opening 60 lying generally in the plane of the first opening 46 of the inlet chute to a second opening 62 at the bottom of the auxiliary chute 58. Walls 64 forming the passage between the first opening 60 and second opening 62 of the auxiliary chute 58 extend through the passage of the inlet chute 44 adjacent the top side thereof to also project through the inlet opening 38 of the drum beyond the plane of the inlet opening to locate the second opening 62 within the hollow interior of the drum spaced axially inward from the inlet end of the drum. When mixing cement for example, the auxiliary chute 58 serves to receive some of the ingredients, namely the cement while other ingredients can be introduced through the inlet chute 44 surrounding the auxiliary chute 58.

Externally of the drum there is provided a pan 65 which is supported at the inlet end of the drum below the inlet opening 38. A top end of the pan 65 is curved about the inlet end wall 34 and the pan slopes downwardly and outwardly away from the drum from the top end to a bottom end so as to be arranged that any material spilt from the inlet end of the drum is deposited on the pan 64 and carried away from the drum and the base frame upon which it is supported.

The inlet chute 44 is pivotally supported on a chute support frame 66 which is fixed relative to the base frame and the longitudinal axis of the drum, at the inlet end of the drum. The chute support frame 66 includes a plurality of members which lie substantially in a common plane which is perpendicular to the axis of rotation of the drum directly adjacent the inlet end wall 34 of the drum. The frame 66 generally comprises two upright posts 68 which are joined by an intermediate cross member 70 and an upper cross member 72. The intermediate cross member spans horizontally between the posts 68 spaced above a height of the inlet end wall 34 while the two posts 68 are spaced apart from one another to be located on opposing sides of the inlet end wall 34 so as not to obstruct the end wall opening covered by the inlet end wall 34. The upper cross member 72 joins the two posts 68 by spanning horizontally therebetween spaced above the intermediate cross member 70. A pair of diagonal cross braces 74 intersects one another and extend diagonally between the cross members 70 and 72 and between the posts 68 for added structural integrity.

The inlet chute 44 is pivotally supported on the chute support frame 66 by a frame assembly comprising a pair of frame member 76 which are also supported to span horizontally between the two posts 68 in the charging position of the chute. Each frame member 76 is supported at a first end on a first one of the posts 68 by a hinge 78 to allow pivotal movement therebetween, while being supported at a second end on a second one of the posts for releasable engagement on a cradle member 80.

The hinges 78 are vertically aligned with one another and define the chute axis about which the inlet chute 44 is pivotal between the charging and access positions. Each hinge is supported on a vertical mounting flange 82 which is fixed on the first one of the posts 68 to lie generally parallel to the drum axis. The hinges are jointed to one another by a common base plate 84 spanning between the two mounting flanges 82. The mounting flanges 82 including horizontal fastener slots to permit independent adjustment of the hinges in the direction of the drum axis relative to the frame 66. The common base plate 84 includes vertically extending fastener slots at both ends thereof for alignment with cooperating ones of the horizontal fasteners slots in the mounting flanges 82 on the post. In this arrangement the hinges can be vertically adjusted in height commonly together and fixed at a selected height by alignment of the fastener slots with the cooperating slots in the mounting flange 82.

A threaded screw member 86 is fastened at a selected spacing between a pair of horizontal plates 88 secured on the post 68 and on the common base plate 84 respectively for controlling vertical position of the base plate relative to the post.

Each hinge includes a horizontal support flange 90 which is fixed on the respective top or bottom end of the common base plate 84 for movement therewith relative to the post. A bearing member 92 is supported on the respective support flange 90 of the each hinge which rotatably supports top and bottom blocks 94 relative to one another about a vertical axis. Fastener slots are provided in the bottom one of the blocks 94 of each hinge which extend horizontally, parallel to the drum axis when the chute is in the charging position for moving the chute towards and away from the drum along the drum axis in the charging position. Selecting a location of fasteners within the respective slots in the blocks 94 permits positioning of the blocks relative to the support flanges 90 and accordingly position of the chute relative to the posts to be adjusted and set in place as desired. Threaded screw members can be mounted in a direction of the drum axis in the charging position for being connected between the support flange 90 and the block 94 of the bearing member of each hinge for adjusting the relative position in the direction of the drum axis as desired.

The first end of each frame member 76 is mounted to the top one of the blocks 94 of the respective hinges by mounting slots located in the frame member which extend in the longitudinal direction of the frame member so as to be horizontal and perpendicular to the drum axis in the charging position. Accordingly, in the charging position, selection of location of fasteners along the slots of the frame members permits lateral positioning of the inlet chute to be adjusted relative to the drum.

In this arrangement each of the hinges is arranged to permit the frame members 76 supporting the inlet chute thereon to be adjusted about three different axes which are perpendicular to one another for adjusting position of the chute relative to the drum and for properly aligning the collar 54 about the second opening of the chute with the inlet opening at the inlet end of the drum. The vertical adjustment along the chute axis of both hinges is commonly adjusted while adjustment in two different directions perpendicular to one another between the frame members 76 and the posts 68 is permitted at each hinge independently of the other and in a plane which is generally perpendicular to the chute axis.

Once the hinges are properly aligned, the inlet chute is pivotal into the charging position so that the first and second openings of the inlet chute are accordingly on opposing sides of the plane of the chute support frame 66. The uppermost one of the two frame members 76 extends along an inner edge of the first opening of the inlet chute generally in the plane of the opening at the top end of the chute while the lowermost one of the frame members 76 extends along the bottom edge of the second opening at the bottom end of the chute. The chute is supported on the frame members by the walls of the chute being mounted directly on the fame members.

Each of the cradle members 80 is supported on the second post at vertically spaced positions thereon for alignment with the second ends of the frame members respectively. A vertical mounting flange 96 is fixed on the post for fastening the respective cradle member 80 thereon. Each cradle member includes a vertical base plate 98 for abutment against the respective mounting flange 96 with cooperating fastener apertures being located in both the flange and the plate to mount the cradle member to the post at an adjustable vertical spacing relative to one another or relative to the post.

Each cradle member has a horizontal supporting surface 100 oriented perpendicularly to the chute axis and arranged for carrying the weight of the frame members thereon independent of any retaining of latching mechanism which retains the inlet chute in the charging position. An outer edge of each supporting surface 100 which is opposite the drum is arranged to be sloped downwardly and outwardly away from the drum for guiding alignment of the respective frame member into the charging position supported on the support surface 100.

Each cradle member 80 further includes a respective stop plate 102 at an inner edge of the supporting surface opposite the sloped edge which prevents over rotation of the frame members beyond the charging position towards the drum. The stop plates 102 also act as gusset plates between the respective horizontal supporting surfaces 100 and the vertical base plates 98. An additional gusset is provided below each supporting surface 100 which again provides additional structural support between the supporting surface and the vertical base plate.

A retainer 104 is provided only on the lowermost one of the cradle members 80 for retaining the respective frame member thereon in the charging position of the chute for accordingly retaining the inlet chute 44 in the charging position as well. The retainer 104 generally comprises a pivot shaft 106 which is supported on the stop plate 102 on the inner side thereof opposite the drum. The shaft 106 is oriented horizontally parallel to a plane of the chute support frame.

A radial arm 108 is coupled to the pivot shaft for pivotal movement about an axis of the shaft through an arc of approximately 90° between the supporting surface 100 and the stop plate 102. A retainer bar 109 extends perpendicularly to the radial arm 108 and is mounted on the outer end thereof opposite the pivot shaft 106. A bracket 110 at the end of the respective frame member associated with the retainer arranges the frame member to have a width which is approximately equal to the dimension of the radial arm 108 between the pivot shaft 106 and the retainer bar 109. The bracket 110 at the end of the frame member is thus suited for being secured between the pivot shaft and the retainer bar 109 when the radial arm is pivoted into a generally horizontal latching position extending outwardly away from the drum.

A slot is formed in the bracket 110 at the end of the frame member which extends vertically downward in a plane of the radial arm 108 for receiving the radial arm 108 therein in the latching position. To release the retainer 104, the retainer bar and radial arm upon which it is mounted are pivoted upwardly to be removed from the slot formed in the top side of the bracket 110 of the frame member in a released position of the retainer. In the released position, the frame member can be pivoted away from the stop plate. The inlet chute can accordingly be pivoted from the charging position to the access position.

Upon returning the frame members into the charging position, the radial arm 108 of the retainer can be pivoted downwardly into the slot in the bracket so that the retainer bar 109 spans the outer side of the frame member and prevents further pivoting movement of the frame member back into the access position when the retainer is in the latching position.

In use the mixer is initially charged by locating the inlet chute in the charging position and loading the materials to be mixed through the appropriate inlet chute or auxiliary chute. The drum is then rotated about its respective longitudinal axis in the mixing direction so that the mixing members 30 and the transfer members 28 together serve to mix the materials in the drum. When the material has been appropriately mixed, the drum is rotated in the opposing transfer direction about the longitudinal axis so that the material is urged by the transfer members towards the outlet end of the drum where the material is accordingly discharged through the discharge opening and the discharge chute 31.

The inlet chute remains in the charging position during rotation of the drum due to the sealing member 40 maintaining a rotatable seal with the collar of the inlet chute. When any maintenance operations require access to the hollow interior of the drum, the retainer 104 is released so that the inlet chute can be pivoted about the chute axis from the charging position to the access position in which the entire chute can be located out of the way to be offset in a radial direction away from the drum axis beyond the periphery of the end wall 34 of the drum. Access can thus be provided through the inlet opening 38, or where greater access is desired through the end wall opening when the inlet end wall 34 is removed.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A batch mixer comprising:

a mixing drum supported for rotation about a respective longitudinal axis extending generally horizontally between an inlet end and an outlet end of the drum;

the mixing drum including a hollow interior arranged for receiving material to be mixed therein;

the inlet end of the drum including an inlet opening formed therein;

the outlet end of the drum having a discharge opening formed therein;

a drive arranged to rotate the mixing drum about the longitudinal axis to mix the material in the drum and to transfer the material in the drum towards the outlet end of the drum;

a plurality of mixing members supported in the hollow interior for rotation with the drum about the longitudinal axis;

the mixing members being arranged to mix the material in the hollow interior of the drum;

a plurality of transfer members supported in the hollow interior for rotation with the drum about the longitudinal axis;

the transfer members being arranged to transfer the material in the hollow interior towards the outlet end of the drum;

a discharge chute supported adjacent the outlet end of the drum and arranged for discharging material from the hollow interior of the mixing drum through the discharge opening at the outlet end;

an inlet chute supported adjacent the inlet end of the drum;

the inlet chute comprising a first opening at a top end arranged to receive the material therein, a second opening at a bottom end, and walls defining a passage from the first opening to the second opening;

the inlet chute being supported for pivotal movement relative to the drum about a generally upright inlet chute axis;

the inlet chute being pivotal about the inlet chute axis between a charging position in which second opening is in communication with inlet opening of drum, and an access position in which inlet opening is substantially unobstructed by the inlet chute.

2. The mixer according to claim 1 wherein the inlet chute axis comprises a vertical axis.

3. The mixer according to claim 1 wherein the inlet chute axis is spaced radially outward from the longitudinal axis beyond a periphery of the inlet opening.

4. The mixer according to claim 1 wherein the second opening of the inlet chute lies in a generally vertical plane.

5. The mixer according to claim 1 wherein the first opening of the inlet chute lies in a generally horizontal plane, and the passage is sloped downwardly at incline from the first opening towards the second opening.

6. The mixer according to claim 1 wherein there is provided a fixed frame in fixed relation to the longitudinal axis of the drum and at least one hinge supporting the inlet chute pivotally on the fixed frame, said at least one hinge being adjustable in position relative to the fixed frame along three different axes which are perpendicular to one another.

7. The mixer according to claim 1 wherein there is provided a fixed frame in fixed relation to the longitudinal axis of the drum and a pair of hinges spaced vertically along the inlet chute axis which support the inlet chute pivotally on the fixed frame, the pair of hinges being coupled to one another so as to be arranged for common adjustment of position together relative to the fixed frame in a direction of the inlet chute axis.

8. The mixer according to claim 1 wherein there is provided a fixed frame in fixed relation to the longitudinal axis of the drum and a pair of hinges spaced vertically along the inlet chute axis which support the inlet chute pivotally on the fixed frame, the pair of hinges being arranged for independent adjustment of position relative to fixed frame along two different axes oriented perpendicular to one another and to the inlet chute axis.

9. The mixer according to claim 1 wherein there is provided a fixed frame in fixed relation to the longitudinal axis of the drum and the inlet chute is supported on a frame assembly which is pivotal with inlet chute about the inlet chute axis relative to the fixed frame, the frame assembly being pivotally supported by at least one hinge at the inlet chute axis at one end of the frame assembly and being arranged to be supported on at least one cradle member on the fixed frame at the other end of the frame assembly in the charging position.

10. The mixer according to claim 9 wherein the frame assembly supporting the inlet chute thereon is arranged to be supported wholly by said at least one hinge and said at least one cradle member and wherein there is provided a retainer arranged to selectively retain the frame assembly on said at least one cradle member.

11. The mixer according to claim 9 wherein said at least one cradle member comprises a supporting surface arranged to support a portion of the frame assembly thereon in the charging position and an inclined surface which is sloped relative to the supporting surface and arranged to guide alignment of said portion of the frame assembly with the supporting surface of the cradle member as the frame assembly is displaced towards the charging position.

12. The mixer according to claim 9 wherein the fixed frame comprises a pair of upright posts spaced apart on opposing sides of the inlet end wall and the frame assembly comprises a pair of frame members hinged on one of the posts and arranged to be supported on the other post in the charging position, one of the pair of frame members spanning generally horizontally adjacent a top end of the inlet opening and one of the pair of frame members spanning generally horizontally adjacent a bottom end of the inlet opening.

13. The mixer according to claim 9 wherein said at least one cradle member is arranged to support a portion of the frame assembly thereon in the charging position and comprises a supporting surface oriented perpendicularly to the inlet chute axis upon which said portion of the frame assembly is arranged to be supported and a stop arranged to prevent pivotal movement of the inlet chute from the access position beyond the charging position.

14. The mixer according to claim 1 wherein there is provided a fixed frame in fixed relation to the longitudinal axis of the drum which pivotally supports the inlet chute thereon, the fixed frame lying in a generally common upright plane.

15. The mixer according to claim 1 wherein the drum comprises an end wall opening at the inlet end of the drum and an inlet end wall which is arranged to span the end wall opening;

the inlet opening is located in the inlet end wall; and a fastening mechanism is arranged to support the inlet end wall spanning the end wall opening so as to permit ready separation and reattachment of the inlet end wall to the inlet end of the drum.

16. The mixer according to claim 1 wherein there is provided an inlet end wall spanning the inlet end of the drum, the inlet chute axis being spaced radially outward from the longitudinal axis beyond a periphery of the inlet end wall.

17. A batch mixer comprising:

a mixing drum supported for rotation about a respective longitudinal axis extending generally horizontally between an inlet end and an outlet end of the drum;

the mixing drum including a hollow interior arranged for receiving material to be mixed therein;

the inlet end of the drum including an inlet opening formed therein;

the outlet end of the drum having a discharge opening formed therein;

a drive arranged to rotate the mixing drum about the longitudinal axis to mix the material in the drum and to transfer the material in the drum towards the outlet end of the drum;

a plurality of mixing members supported in the hollow interior for rotation with the drum about the longitudinal axis;

the mixing members being arranged to mix the material in the hollow interior of the drum;

a plurality of transfer members supported in the hollow interior for rotation with the drum about the longitudinal axis;

the transfer members being arranged to transfer the material in the hollow interior towards the outlet end of the drum;

a discharge chute supported adjacent the outlet end of the drum and arranged for discharging material from the hollow interior of the mixing drum through the discharge opening at the outlet end;

an inlet chute supported adjacent the inlet end of the drum;

the inlet chute comprising a first opening at a top end arranged to receive the material therein, a second opening at a bottom end through which the material is arranged to be dispensed into the drum, and walls defining a passage from the first opening to the second opening;

the inlet chute being supported for movement between a charging position in which second opening is in communication with inlet opening of drum, and an access position in which inlet chute is spaced from the inlet opening of the drum;

the drum comprising an end wall opening at the inlet end of the drum and an inlet end wall which is arranged to span the end wall opening;

the inlet opening being located in the inlet end wall;

a fastening mechanism arranged to support the inlet end wall spanning the end wall opening so as to permit ready separation and reattachment of the inlet end wall to the inlet end of the drum; and a seal between the inlet chute and the inlet end wall comprising a sealing member about the inlet opening and a collar concentric with the sealing member in which one of the sealing member and the collar is supported on the inlet end wall and the other one of the sealing member and the collar is supported on the inlet chute such that the sealing member and the collar are in rotatable sealing engagement with one another in the charging position of the inlet chute.

18. The mixer according to claim 17 wherein the fastening mechanism comprises a plurality of threaded fasteners fastening the inlet end wall to the drum about a periphery of the end wall opening at the inlet end of the drum.

19. The mixer according to claim 17 wherein the drum is reduced in diameter towards the inlet end thereof such that the inlet end wall spanning the inlet end of the drum is smaller in diameter than the drum.

20. The mixer according to claim 17 wherein the inlet end wall supports the sealing member about the inlet opening in the inlet end wall, the sealing member being arranged for rotatable engagement with the inlet chute for relative rotation therebetween in the charging position of the inlet chute.

21. The mixer according to claim 17 wherein there is provided a peripheral mounting flange projecting radially outwardly from the inlet end of the drum, the inlet end wall being fastened to the peripheral mounting flange.

* * * * *